US005735292A

United States Patent [19]

Draghetti

[11] Patent Number: 5,735,292

[45] Date of Patent: Apr. 7, 1998

[54] METHOD AND DEVICE FOR THE PRODUCTION OF FILTER TIP BANDS FOR VENTILATED CIGARETTES

[75] Inventor: Fiorenzo Draghetti, Medicina, Italy

[73] Assignee: G.D. S.p.A., Bologna, Italy

[21] Appl. No.: 726,490

[22] Filed: Oct. 7, 1996

[30] Foreign Application Priority Data

Oct. 6, 1995 [IT] Italy ..... B095A0474

[51] Int. Cl.[6] ..... A24C 5/38

[52] U.S. Cl. ..... 131/34; 131/35; 131/69; 131/37; 131/90; 131/91; 131/95; 131/281; 131/284

[58] Field of Search ..... 131/33, 43, 35, 131/69, 90, 91, 95, 281, 284, 37, 910, 84.4, 65

[56] References Cited

U.S. PATENT DOCUMENTS

| | | | |
|---|---|---|---|
| 3,604,429 | 9/1971 | DeWitt | 131/65 |
| 4,361,156 | 11/1982 | Hall | 131/35 X |
| 4,598,719 | 7/1986 | Mattei et al. | 131/65 X |
| 4,653,516 | 3/1987 | Mattei | 131/65 X |
| 5,222,509 | 6/1993 | Imai et al. | 131/284 X |
| 5,497,790 | 3/1996 | Fujishige | 131/84.4 |

FOREIGN PATENT DOCUMENTS

| | | | |
|---|---|---|---|
| 042 665 | 12/1981 | European Pat. Off. . | |
| 513 649 | 11/1992 | European Pat. Off. . | |
| 0613623 | 9/1994 | European Pat. Off. | 131/84.4 |
| 674 851 | 10/1995 | European Pat. Off. . | |
| 87 956 | 6/1991 | Luxembourg . | |
| 2 033 726 | 5/1980 | United Kingdom . | |
| 2066130 | 7/1981 | United Kingdom | 131/281 |

*Primary Examiner*—Vincent Millin

*Attorney, Agent, or Firm*—Cushman Darby & Cushman Intellectual Property Group of Pillsbury Madison & Sutro LLP

[57] ABSTRACT

A method and device for the production of filter tip bands for ventilated cigarettes, according to which a continuous strip is advanced along a pre-set feed path, an adhesive substance is applied to the strip using a gumming device, defining on the strip itself a periodic succession of gummed areas alternated with non-gummed areas and the strip is cut using a cutting device according to transversal lines at pre-set intervals defined by the gummed areas to produce the bands. A control device controls the timing between the gumming device and the cutting device. The timing is compared with a pre-set value and is corrected, using a correction device in order to eliminate any variation of the pre-set value.

7 Claims, 1 Drawing Sheet

METHOD AND DEVICE FOR THE PRODUCTION OF FILTER TIP BANDS FOR VENTILATED CIGARETTES

BACKGROUND OF THE INVENTION

The the present invention relates to a method for the production of filter tip bands for ventilated cigarettes.

In particular, the present invention relates to a method for cutting, in a precise and controlled manner, a strip unwound from a reel, to which a gumming device applies a layer of adhesive on one side before it is cut into single pieces, to make filter tip bands.

It is common practice, in the so-called filter tip machines, to apply the filter to the cigarette, wrapping a filter piece and part of the cigarette with a band. The filter piece is double the length of the filter tip of a single cigarette and is placed between two cigarettes; the double cigarette is then cut in half to produce two filtered cigarettes.

The well-known devices capable of producing the bands, basically, include a gumming unit designed to smear an adhesive substance on the continuous strip in pre-set areas and, downstream of the gumming unit, a cutting unit to cut the continuous strip into bands, transversely.

The gumming unit includes a gumming roller, whose cylindrical surface has recesses. Because of this shape, the strip, after the gumming, has areas without adhesive material corresponding to these recesses.

The above described areas without adhesive material are essential for ventilated cigarettes, or, more precisely, for cigarettes with ventilated filters. In fact, in these areas, there are ventilation holes, which must not in any way be blocked by the adhesive material.

The above described cutting unit generally includes a rotating knife with peripheral blades spaced at an equal distance from each other. These peripheral blades must act on the strip along well defined transversal lines, positioned, in particular, in the space between an area without any adhesive substance and the next one.

In the well-known devices, the transversal cutting of the strip into bands may occur in the wrong place, involving the areas without adhesive substance. A problem of this kind, however the holes are made, creates insufficient ventilation of the cigarettes and/or incomplete closure of the filter tip bands.

The object of the present invention is to provide a method for the production of filter tip bands for ventilated cigarettes, without the problem described above.

SUMMARY OF THE INVENTION

The present invention provides a method for the production of filter tip bands for ventilated cigarettes characterized in that it includes the steps of feeding a continuous strip along a pre-set feed path; applying an adhesive substance to the strip using gumming means, defining on the strip itself a periodic succession of gummed areas alternated with non-gummed areas; cutting the strip using cutting means along transversal lines at pre-set intervals defined by the gummed areas in order to produce the bands; controlling, using control means, the timing between the gumming means and the cutting means; comparing the timing with a pre-set value; and correcting the timing, using correction means, in order to eliminate variations with respect to the pre-set value.

The present invention also relates to a device for the production of filter tip bands for ventilated cigarettes designed to carry out the above-mentioned method.

The device for the production of filter tip bands for ventilated cigarettes as provided by the present invention is characterized in that it includes means for feeding a continuous strip along a pre-set feed path, means for gumming the strip along the path, the means being able to smear an adhesive substance on the strip, defining on the strip itself a periodic succession of gummed areas alternated with non-gummed areas; means for cutting the strip positioned downstream of the gumming means in order to produce the bands; control means to set the timing between the gumming means and the cutting means and to compare the timing itself with a pre-set value; and means for correcting the timing in order to eliminate any variation with respect to the pre-set value, the correction means being controlled by the control means.

BRIEF DESCRIPTION OF THE DRAWINGS

Further characteristics and advantages of the invention are apparent from the detailed description which follows, with reference to the accompanying drawings, which illustrate a preferred embodiment of the invention by way of example, and in which.

DESCRIPTION OF THE PREFERRED EMBODIMENT

Figures 1, 2:
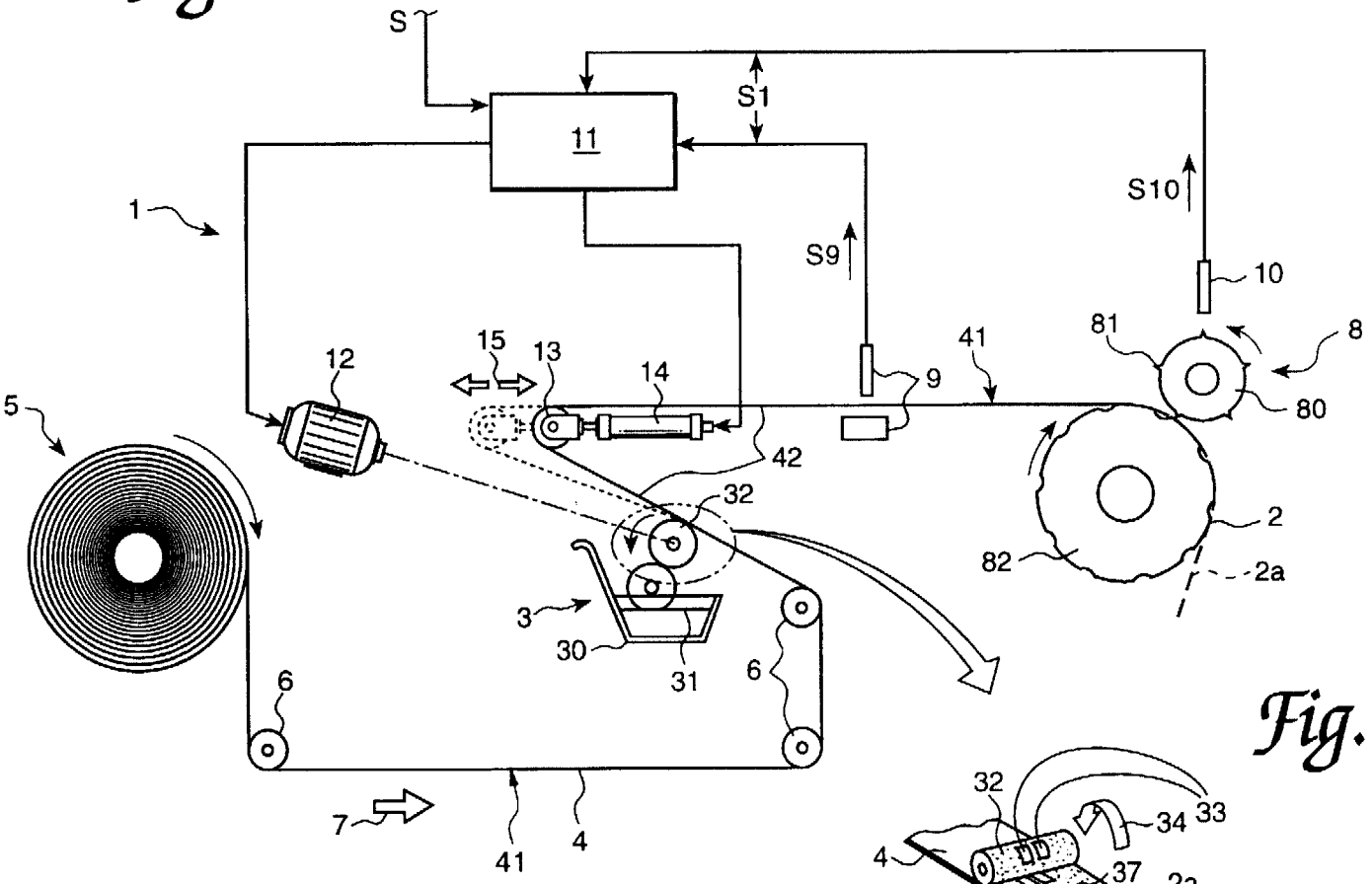
FIG. 1 is a schematic side view of a preferred embodiment of the device, according to the present invention.
FIG. 2 is a schematic perspective view of a part of the device illustrated in FIG. 1.

With reference to FIG. 1, the numeral 1 indicates the device as a whole for the production of filter tip bands 2 to be attached to filter pieces (not illustrated) for ventilated cigarettes (not illustrated).

The device 1 is part of a cigarette packing machine of a well-known type (not illustrated).

The device 1 includes a gumming unit 3 which smears an adhesive substance on pre-set areas of a continuous paper strip 4.

The continuous strip 4 is unwound in a well-known way from a feed reel 5 and reaches the gumming unit 3 at a pre-set speed in the direction indicated by the arrow 7 and is guided by a series of transmission rollers 6 along a path 41.

The gumming unit 3 includes a cup 30 containing an adhesive substance, a rotating roller 31 partially submerged in the same adhesive substance and a gumming roller 32 tangent to the roller 31 which rotates in an anti-clockwise direction in FIG. 1 (arrow 34 in FIG. 2) driven by a motor 12.

The gumming roller 32 is designed to transfer the adhesive substance from the surface of the roller 31 to the surface of the strip 4 tangent to it. As shown in FIG. 2, the roller 32 has recesses 33 in its outer surface, into which the adhesive substance cannot penetrate and which, therefore, during the gumming phase, gives a regular succession of areas without adhesive substance 35 to the strip 4.

If the continuous strip 4 is already perforated, these areas 35 must correspond to the perforated areas of the strip 4. The areas without adhesive material 35 are positioned one after the other in the feed direction 7 of the strip and are alternated with completely gummed areas 36, that is, areas completely smeared with adhesive substance from one end of the strip 4 to the other. As shown in FIG. 1, downstream of the gumming unit 3, in the direction 7, along a section 42 of the path 41, there is a cutting unit 8 which cuts the continuous strip 4 transversally into the bands 2.

The unit 8 includes a roller 80, which turns in an anti-clockwise direction in FIG. 1 around its own horizontal axis which is perpendicular to the direction 7 at a set rotating speed and is fitted with peripheral blades 81 which are equally spaced out from each other. A drum 82, on an axis parallel to that of the roller 80, feeds the strip 4 along the path 41 in the direction 7 and is designed to operate in conjunction with the roller 80 to cut the strip 4 itself into bands 2 along transversal cutting lines 2*a*.

The strip 4 reaches the periphery of the drum 82 at a tangent, the drum being fitted with suction means, of a well-known type and not illustrated, which keep the strip 4 against the drum 82 itself. Again according to FIG. 1, the device 1 also envisages control means, consisting of a sensor 9 and a detector 10, and a control unit 11.

The sensor 9 is positioned above the section 42 between the gumming unit 3 and the cutting unit 8 and is used to issue a signal, during the feeding of the strip 4 in the direction 7, when the reference mark on every section of strip 4 which shall, after the cutting, form a single band 2, passes. On the passing of every reference mark which can, for example, consist of an area 35 or a perforation, the sensor 9 sends a signal S9 to the control unit 11.

The detector 10 is connected to the roller 80 and can, upon detection of the passing of every blade 81, send a signal S10 to the unit 11.

The unit 11, in which the feed speed of the strip 4 and the angular speed of the knife 80 are pre-set, compares the signal corresponding to the timing between a signal sent by the sensor 9 and a signal sent by the detector 10 with a signal S of a pre-set value.

If there are any deviations higher than the pre-set value with respect to signal S the unit 11 enables the correction means.

In particular, if the control unit 11 detects an incorrect timing between the cutting lines 2*a* and corresponding gummed areas, the correction means are enabled in order to modify the relative positioning between the blades 81 and the areas 35 so that the cutting is carried out on the completely gummed areas 36.

The correction means include a drive motor 12 for the roller 32 whose timing is controlled, in a well-known way, by a command signal sent by the unit 11.

The correction means also include a transmission roller 13 driven by a double-action cylinder 14, the latter being controlled by a signal given by the unit 11.

The roller 13 is connected to the continuous strip 4, in the section between the gumming unit 3 and the sensor 9, in such a way as to extend or shorten the path of the strip 4 between the gumming unit 3 and the cutting unit 8.

In use, the unit 11 constantly compares the signal S1 corresponding to the timing between the signals S9 and S10 with a reference signal S which corresponds to a pre-set value.

Every time a deviation between the signal S1 and the signal S, or an incorrect timing between the cutting lines 2*a* and the non-gummed areas 35 is detected, the unit 11 can correct the timing to eliminate the deviation by operating on the motor 12 to change, temporarily, the speed of the gumming roller 32 and/or to enable the cylinder 14 to extend or shorten the section 42 of the strip 4 feeding path 41.

What is claimed is:

1. A method for producing filter tip bands for ventilated cigarettes, comprising the steps of:

feeding a continuous strip of bank stock longitudinally along an established feed path;

applying an adhesive substance to the strip at a gumming station located on said path, using a gumming device, so as to define on the strip a longitudinally periodic succession of gummed areas alternated with non-gummed areas;

repeatedly cutting the strip transversely at a cutting station located longitudinally further along said path than said gumming station, using a cutter acting along transverse cutting lines spaced from one another by preset intervals which coincide with respective ones of said gummed areas, thereby producing a succession of bands;

continually sensing actual spatial disposition of said periodic succession at a sensing station located between said gumming device and said cutter;

comparing said actual spatial disposition relative to said cutter, with a desired spatial disposition relative to said cutter; and continually correcting said periodic succession upstream of said sensing station, using feedback control from said sensing station, for eliminating variations in said actual spatial disposition from said desired spatial disposition.

2. The method of claim 1, wherein:

said continually sensing further includes continually sensing actual spatial disposition of said cutter at said cutting station; and said comparing includes comparing a first signal indicative of actual spatial disposition of said periodic succession, obtained at said sensing station, with a second signal indicative of actual spatial disposition of said cutter, obtained at said cutting station.

3. The method of claim 1, wherein:

said continually correcting is accomplished at least in part by speeding up and slowing down operation of said gumming device relative to speed of feeding of said strip through said gumming station.

4. The method of claim 1, wherein:

said continual correcting is accomplished at least in part by lengthening and shortening the length of said path between said gumming station and said cutting station.

5. Apparatus for producing filter tip bands for ventilated cigarettes, comprising:

a set of feeding devices arranged for feeding a continuous strip of band stock longitudinally along an established feed path;

an applicator arranged for applying an adhesive substance to the strip at a gumming station located on said path, including a gumming device, so as to define on the strip a longitudinally periodic succession of gummed areas alternated with non-gummed areas;

a cutter arranged for repeatedly cutting the strip transversely at a cutting station located longitudinally further along said path than said gumming station, acting along transverse cutting lines spaced from one another by preset intervals which coincide with respective ones of said gummed areas, thereby producing a succession of bands;

first and second sensors respectively for continually sensing actual spatial disposition of said periodic succession at a sensing station located between said gumming device, and actual spatial disposition of said cutter;

a control unit arranged for comparing said actual spatial disposition of said periodic succession relative to said cutter, with a desired spatial disposition of said periodic succession relative to said cutter; and feedback control lines from said control unit, arranged for continually correcting said periodic succession upstream of said sensing station, using feedback control from said sensing station, for eliminating variations in said actual spatial disposition of said periodic succession from said desired spatial disposition.

6. The apparatus of claim 5, wherein:

said control unit is arranged for providing said continually correcting via said feedback control lines at least in part by speeding up and slowing down operation of said gumming device relative to speed of feeding of said strip through said gumming station.

7. The apparatus of claim 5, wherein:

said control unit is arranged for providing said continual correcting via said feedback control lines at least in part by lengthening and shortening the length of said path between said gumming station and said cutting station.

* * * * *